US005217297A

United States Patent [19]

Yuen

[11] Patent Number: 5,217,297

[45] Date of Patent: Jun. 8, 1993

[54] COMBINED INCANDESCENT/FLUORESCENT LANTERN

[75] Inventor: John Yuen, Kowloon, Hong Kong

[73] Assignee: John Manufacturing Limited, Kowloon, Hong Kong

[21] Appl. No.: 757,599

[22] Filed: Sep. 11, 1991

[30] Foreign Application Priority Data

Sep. 28, 1990 [GB] United Kingdom ..... 9021155

[51] Int. Cl.[5] ..... F21L 11/00

[52] U.S. Cl. ..... 362/184; 362/183; 362/199; 362/228

[58] Field of Search ..... 362/183, 184, 197, 199, 362/200, 217, 228, 427, 190, 229

[56] References Cited

U.S. PATENT DOCUMENTS

| | | | |
|---|---|---|---|
| 287,292 | 12/1986 | Yuen . | |
| 1,974,294 | 9/1934 | Walsh | 362/208 |
| 2,959,667 | 11/1960 | Cheng . | |
| 3,030,497 | 4/1962 | Cheng | 362/184 |
| 3,053,978 | 9/1962 | Rhoades | 362/184 |
| 4,218,637 | 8/1980 | Zelina, Jr. | 362/184 |
| 4,321,657 | 3/1982 | Hoi | 362/184 |
| 4,327,401 | 4/1982 | Siiberg | 362/183 |
| 4,432,043 | 2/1984 | Yuen | 362/184 |
| 4,467,403 | 8/1984 | May . | |
| 4,575,784 | 3/1986 | Diau | 362/183 |
| 4,713,735 | 12/1987 | Hiltman | 362/183 |
| 4,977,489 | 12/1990 | Fung | 362/184 |

FOREIGN PATENT DOCUMENTS

| | | | |
|---|---|---|---|
| 2071300 | 9/1981 | United Kingdom | 362/190 |

*Primary Examiner*—Ira S. Lazarus
*Assistant Examiner*—Y. Quach
*Attorney, Agent, or Firm*—Fay, Sharpe, Beall, Fagan, Minnich & McKee

[57] ABSTRACT

A lantern has a housing with a front end portion, a handle portion and a base portion with an incandescent bulb and a reflector in the front end portion and a fluorescent tube in the base portion. The base portion can be rotated by means of a rotatable joint through 180° so that, using the front end portion as a base, the fluorescent tube can be positioned and angled to give optimum illumination for any particular use.

5 Claims, 4 Drawing Sheets

COMBINED INCANDESCENT/FLUORESCENT LANTERN

BACKGROUND OF THE INVENTION

The invention relates to a combined incandescent/-fluorescent lantern.

Lanterns have been previously proposed which include both an incandescent bulb which cooperates with a reflector to provide a beam of light which can be directed and also a fluorescent tube which can be energized to give more general diffused illumination. Particularly prior proposals have comprised a generally rectangular elongate housing with the incandescent bulb and reflector provided to direct an axial beam from one end and a side face of the housing having the fluorescent tube therein.

SUMMARY

In a combined incandescent/fluorescent lantern according to the invention a housing has a front end portion with a relatively large end area having an incandescent bulb and reflector therein, and a lower base portion and an upper handle portion extending generally in parallel rearwardly from the front end portion and being coupled at the rear end by a rotatable joint with a transverse axis, the base portion including a fluorescent tube therein and being pivotable about the rotatable joint to separate the front end thereof from the front end portion and movable to any position within an arc of substantially 180° to position the fluorescent tube at a desired position for optimum illumination for a particular use.

Thus the reflector diameter which is desirably large for a wide directed beam can be accommodated in the wide front end portion which then provides a stable base for the lantern when used with the fluorescent tube illuminated. With the front end portion standing on a horizontal work surface the fluorescent tube can provide forwardly directed illumination if the base portion is rotated through 180° and in that position is spaced upwardly by the length of the handle portion from the work surface or if rotated through less than 180° can provide a partially or fully downwardly directed light, which could be optimum for example for reading a document placed on the work surface.

Preferably the lantern has a battery compartment provided in the handle portion. Advantageously it also includes a jack for receiving a power lead, for example for connection to the cigar lighter of a motor vehicle.

BRIEF DESCRIPTION OF THE DRAWING

The invention is diagrammatically illustrated by way of example in the accompanying drawings in which.

DETAILED DESCRIPTION OF THE EMBODIMENT

Figure 2:
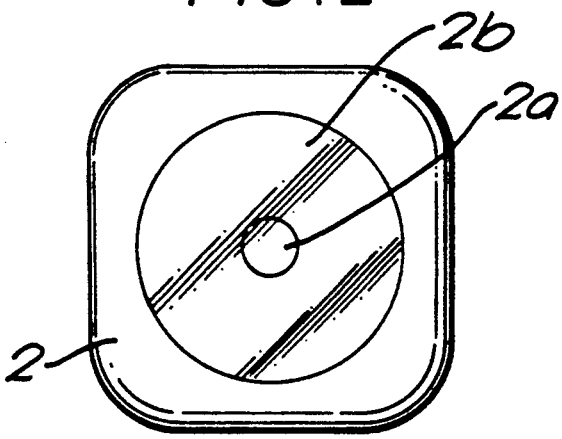
FIG. 2 is a front end view of the lantern of FIG. 1.

Referring to the drawings, a lantern 1 has a front end portion 2 a handle portion 3 and a base portion 4. As shown in FIG. 2 the front end portion 2 has an incandescent bulb 2*a* and a reflector 2*b* behind a transparent glass whereby it can direct a forward generally parallel beam of light.

The handle portion 3 and the base portion 4 are coupled at a rotatable joint 5 with a transverse axis.

Figure 1:
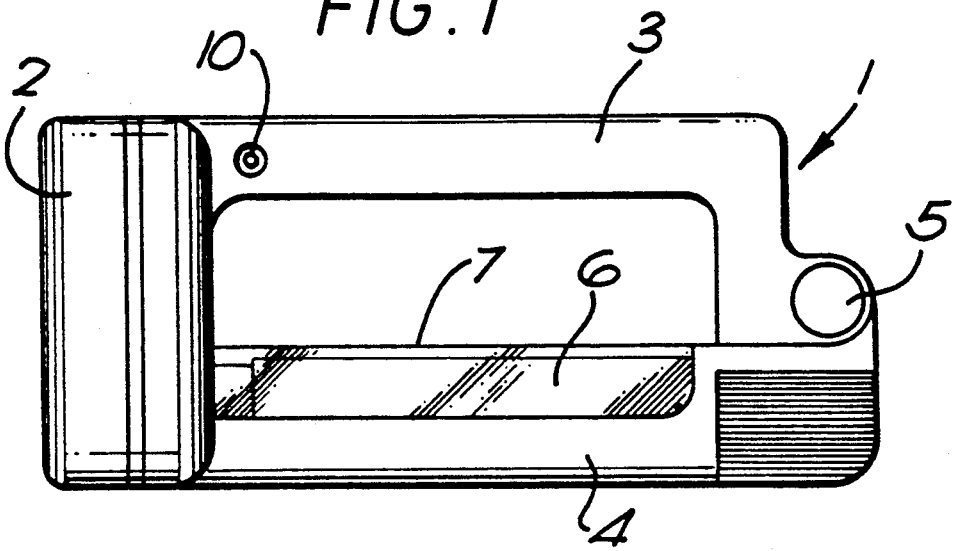
FIG. 1 is a side view of a combined incandescent/-fluorescent lantern according to the invention.
Figure 6:
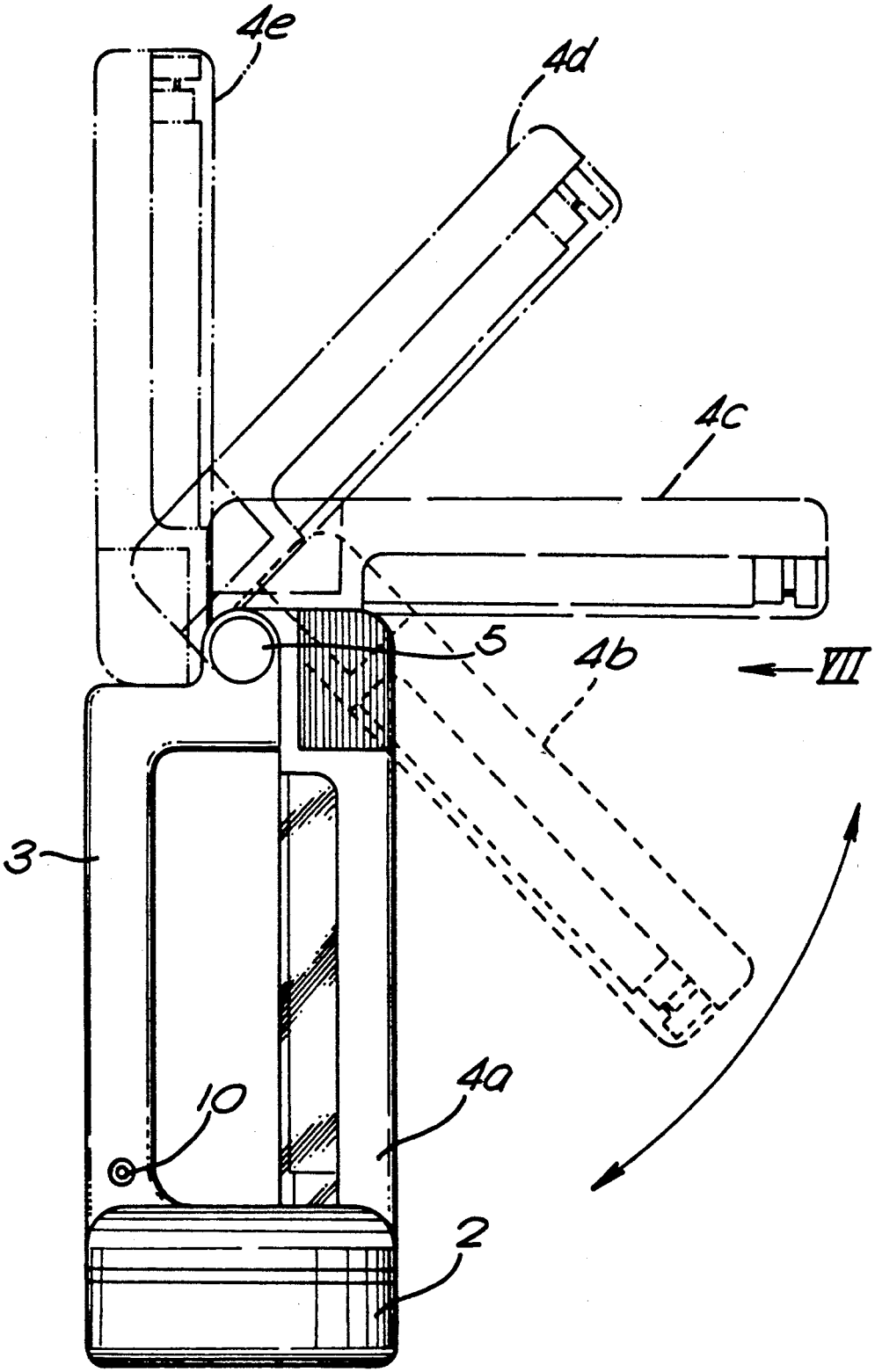
FIG. 6 is a view generally corresponding to FIG. 1 but with the lantern standing on its front end and showing alternative positions for a base portion thereof.
Figure 7:
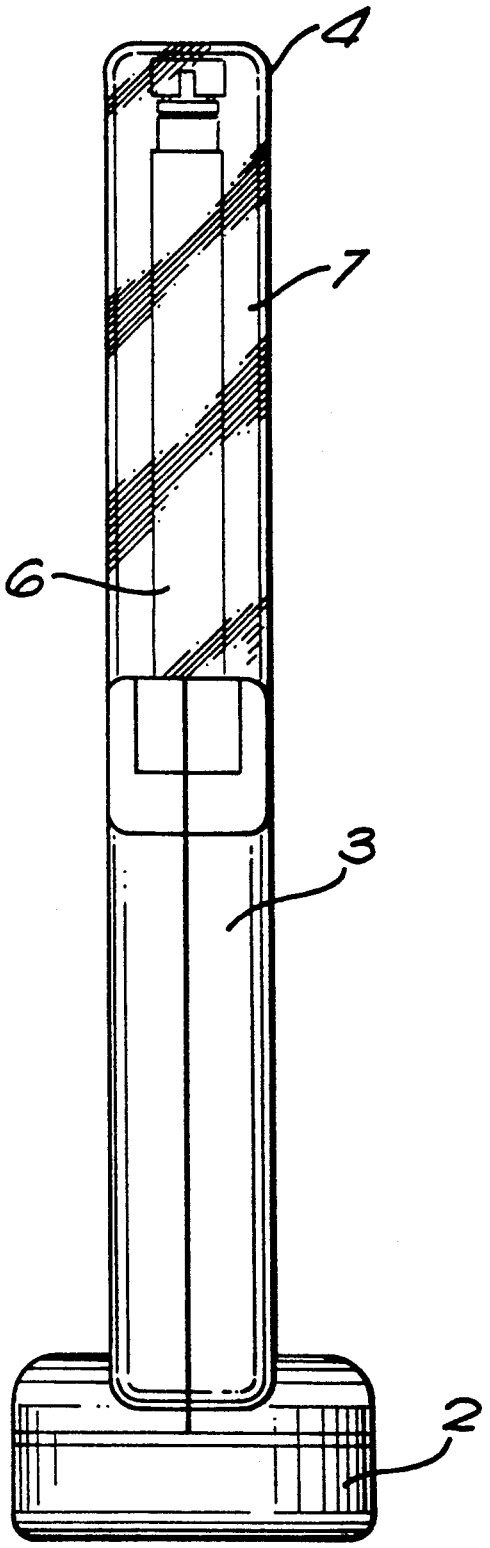
FIG. 7 is a view taken in the direction of arrow VII of FIG. 6 with the base portion in a fully raised position.

An upper side of the base portion 4 has a fluorescent tube 6 therein covered by a semi-cylindrical transparent cover 7 and the left hand end, as viewed in FIG. 1 of the base portion 4 is not connected to the front end portion 2 such that the base portion 4 is rotatable by means of the rotatable joint 5 to any one of positions 4*a*, 4*b*, 4*c*, 4*d* and 4*e* indicated in FIG. 6. Which of the positions 4*a* to 4*e* is selected depends upon the particular use, that is to say particular kind of illumination required from the fluorescent tube 6. The position 4*e* will give a generally horizontally directed light from a height above a work surface on which the front end portion 2 is placed corresponding to the length of the handle 3 whereas the position 4*c* for example will give a vertically downwardly directed illumination towards the work surface.

Figure 3:
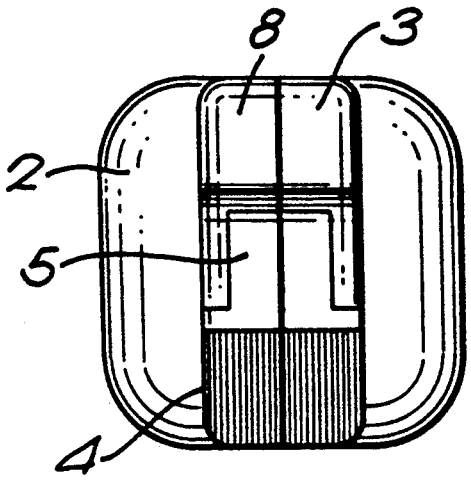
FIG. 3 is a rear end view of the lantern of FIG. 1.
Figure 4:
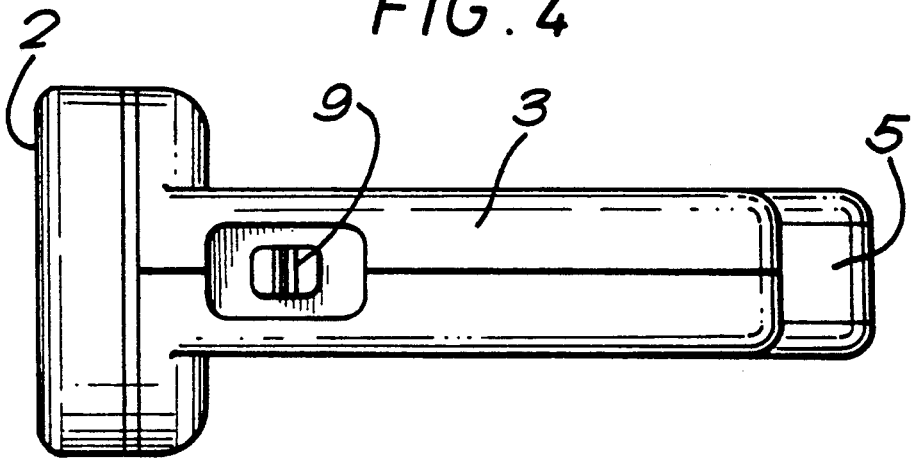
FIG. 4 is a plan view of the lantern of FIG. 1.
Figure 5:
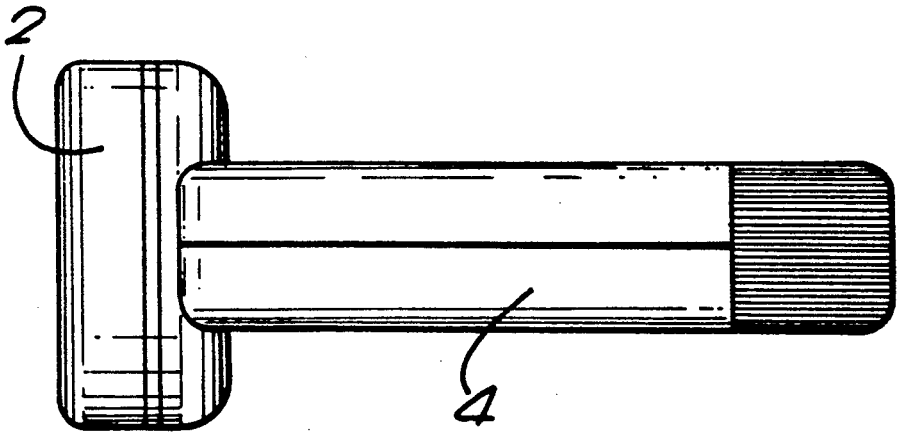
FIG. 5 is an underneath plan view of the lantern of FIG. 1.

A battery compartment is provided behind a closure flap 8 shown in FIG. 3, a control switch 9 is provided on the upper face of the handle 3 when the lantern is in the position shown in FIG. 1 and a socket 10 for a jack for recharging the battery or illuminating either the incandescent bulb 2*a* or the fluorescent tube 6 from an external power source, such as a motor vehicle battery, is provided in the side of the handle portion 3.

While a preferred embodiment has been set forth along with modifications and variations to show specific advantageous details of the present invention, further embodiments, modifications and variations are contemplated within the broader aspects of the present invention, all as set forth by the spirit and scope of the following claims.

What is claimed is:

1. A combined incandescent/fluorescent lantern having:

a housing with a longitudinal direction and including a front end portion with a relatively large end area;

an incandescent bulb and a reflector mounted in said front end portion for projecting a beam of light in the longitudinal direction;

said housing further comprising a longitudinally elongated lower base portion and a longitudinally elongated upper handle portion extending generally in longitudinal parallel relationship to each other rearwardly from said front end portion;

said longitudinally elongated lower base portion and said longitudinally elongated upper handle portion being transversely spaced apart;

a rotatable joint with only a single transverse axis coupling together rear ends of said longitudinally elongated lower base portion and said longitudinally elongated upper handle portion, said single transverse axis extending at right angles to the longitudinal direction so that said longitudinally elongated lower base portion and said longitudinally elongated upper handle portion pivot about said single transverse axis in a plane parallel to the longitudinal direction;

a fluorescent tube in said longitudinally elongated lower base portion, for projecting light symmetrically with respect to the plane; and said longitudinally elongated lower base portion being pivotable about said rotatable joint in the plane from the longitudinal parallel relationship to separate a front end of said lower longitudinally elongated base portion from said front end portion and being movable to any position within an arc of substantially 180° with respect to said longitudinally elongated upper handle portion, with said front end portion standing on a horizontal support surface so that the longitudinal direction is vertical, to position said fluorescent tube at any desired position and angle within the arc of the plane for optimum illumination for a particular use.

2. The combined incandescent fluorescent lantern as claimed in claim 1, in which a battery compartment is provided in said longitudinally elongated upper handle portion.

3. The combined incandescent fluorescent lantern as claimed in claim 1, including an electrical socket.

4. A combined incandescent fluorescent lantern having:

a housing with a longitudinal direction and including a front end portion with a relatively large end area;

an incandescent bulb and a reflector mounted in said front end portion for projecting a beam of light in the longitudinal direction;

said housing further comprising a longitudinally elongated lower base portion and a longitudinally elongated upper handle portion extending generally in longitudinal parallel relationship to each other rearwardly from said front end portion;

said longitudinally elongated lower base portion and said longitudinally elongated upper handle portion being transversely spaced apart;

a rotatable joint with only a transverse axis coupling together rear ends of said longitudinally elongated lower base portion and said longitudinally elongated upper handle portion, said transverse axis extending at right angles to the longitudinal direction so that said longitudinally elongated lower base portion and said longitudinally elongated upper handle portion pivot about said transverse axis in a plane parallel to the longitudinal direction;

a fluorescent tube in said longitudinally elongated lower base portion, for projecting light symmetrically with respect to the plane;

said longitudinally elongated lower base portion being pivotable about said rotatable joint in the plane from the longitudinal parallel relationship to separate a front end of said lower longitudinally elongated base portion from said front end portion and being movable to any position within an arc of substantially 180° with respect to said longitudinally elongated upper handle portion, with said front end portion standing on a horizontal support surface so that the longitudinal direction is vertical, to position said fluorescent tube at any desired position and angle within the arc of the plane for optimum illumination for a particular use; and said longitudinally elongated lower base portion and said longitudinally elongated upper handle portion being spaced apart from each other sufficiently in the longitudinal parallel relationship such that said longitudinally elongated upper handle portion forms a handle independently of said longitudinally elongated lower base portion.

5. A combined incandescent fluorescent lantern having:

a housing with a longitudinal direction and including a front end portion with a relatively large end area;

an incandescent bulb and a reflector mounted in said front end portion for projecting a beam of light in the longitudinal direction;

said housing further comprising a longitudinally elongated lower base portion and a longitudinally elongated upper handle portion extending generally in longitudinal parallel relationship to each other rearwardly from said front end portion;

said longitudinally elongated lower base portion and said longitudinally elongated upper handle portion being transversely spaced apart;

a rotatable joint with only a transverse axis coupling together rear ends of said longitudinally elongated lower base portion and said longitudinally elongated upper handle portion, said transverse axis extending at right angles to the longitudinal direction so that said longitudinally elongated lower base portion and said longitudinally elongated upper handle portion pivot about said transverse axis in a plane parallel to the longitudinal direction;

a fluorescent tube in said longitudinally elongated lower base portion, for projecting light symmetrically with respect to the plane;

said longitudinally elongated lower base portion being pivotable about said rotatable joint in the plane from the longitudinal parallel relationship to separate a front end of said lower longitudinally elongated base portion from said front end portion and being movable to any position within an arc of substantially 180° with respect to said longitudinally elongated upper handle portion, with said front end portion standing on a horizontal support surface so that the longitudinal direction is vertical, to position said fluorescent tube at any desired position and angle within the arc of the plane for optimum illumination for a particular use; and said longitudinally elongated lower base portion and longitudinally elongated upper handle portion being spaced apart such that the space between said longitudinally elongated upper handle portion and said longitudinally elongated lower base portion is larger than the thickness of the longitudinally elongated upper handle portion as measured in the plane and perpendicular to the longitudinal direction.

* * * * *